United States Patent [19]

Peterson

[11] Patent Number: 5,048,725

[45] Date of Patent: Sep. 17, 1991

[54] WALL MOUNTABLE TOOTHPASTE DISPENSER WITH MAGNETIC TUBE-WINDER HOLDING MEANS

[76] Inventor: Mildred I. Peterson, 1000 S. Semoran Blvd., #501, Winter Park, Fla. 32792

[21] Appl. No.: 620,739

[22] Filed: Dec. 3, 1990

[51] Int. Cl.[5] ..... B65D 35/34

[52] U.S. Cl. ..... 222/100; 222/105; 222/494

[58] Field of Search ..... 222/92, 95, 99, 100, 222/105, 107, 494

[56] References Cited

U.S. PATENT DOCUMENTS

| | | | |
|---|---|---|---|
| 1,839,542 | 1/1932 | Ferguson | 222/93 |
| 2,097,308 | 10/1937 | Ruth | 221/60 |
| 2,605,932 | 8/1952 | Locke | 222/93 X |
| 2,760,681 | 8/1956 | Arquelles et al. | 222/93 |
| 2,822,111 | 2/1958 | Tripoli | 222/100 |
| 3,020,914 | 2/1962 | Corky | 222/105 X |
| 3,074,598 | 1/1963 | Barton | 222/100 |
| 3,160,323 | 12/1964 | Weisberg | 222/107 |
| 3,241,721 | 3/1966 | Freeman | 222/93 |
| 3,260,412 | 7/1966 | Larkin | 222/107 |
| 3,917,118 | 11/1975 | Odgen | 222/100 |
| 4,997,107 | 3/1991 | Snyder et al. | 222/99 X |

FOREIGN PATENT DOCUMENTS

| | | | |
|---|---|---|---|
| 9008072 | 7/1990 | PCT Int'l Appl. | 222/99 |

*Primary Examiner*—Michael S. Huppert
*Assistant Examiner*—Joseph A. Kaufman
*Attorney, Agent, or Firm*—Edward M. Livingston

[57] ABSTRACT

A tube-packaged-product dispenser is provided with a tube-winder knob 2 at each end of a slotted tube-winder rod 1 that is extended through channels 3 at opposite sides of a container 5 into which a tube 9 is inserted. A magnetic ring 22 with magnetic attraction to surfaces 23 of the channels 3 hold the knobs 2 with sufficient rigidity to prevent unwinding of the tube 9 after it has been wound onto the rod 1. Bondable strips 24, 26, 14, 36, 38 with magnetic or other attraction to each other positioned at opposite sides of the tube are brought into binding contact with each other with the effect of squeezing sides of the tube together and further preventing unwinding of the tube. A spout anchor nut 20 or 43 is threaded onto the exit spout 10 of the tube 9 at the opposite side of the container bottom 11 with an anchor orifice 40 into which the spout is positioned for use. A magnetic tube spout ring 44 just above the threads of tube 9, with magnetic attraction to the magnetic surface 45 around the anchor orifice 40 into which the spout 10 is positioned for use, will further hold tube 9 with sufficient rigidity to prevent wobbling of the tube 9 when being wound by tube winder knobs 2. A resilient orifice 39, 41, 42 in the spout nut 20 forms contents of the tube into ribbon shape as ejected and prevents drip from the tube when not being used. Toothbrushes, other use items and ornamentation are positionable on the outside surface of the container. The container is attachable to a wall with nail-head orifices 32 and to a mirror or other flat surface with suction cups 34.

35 Claims, 2 Drawing Sheets

FIG. 5
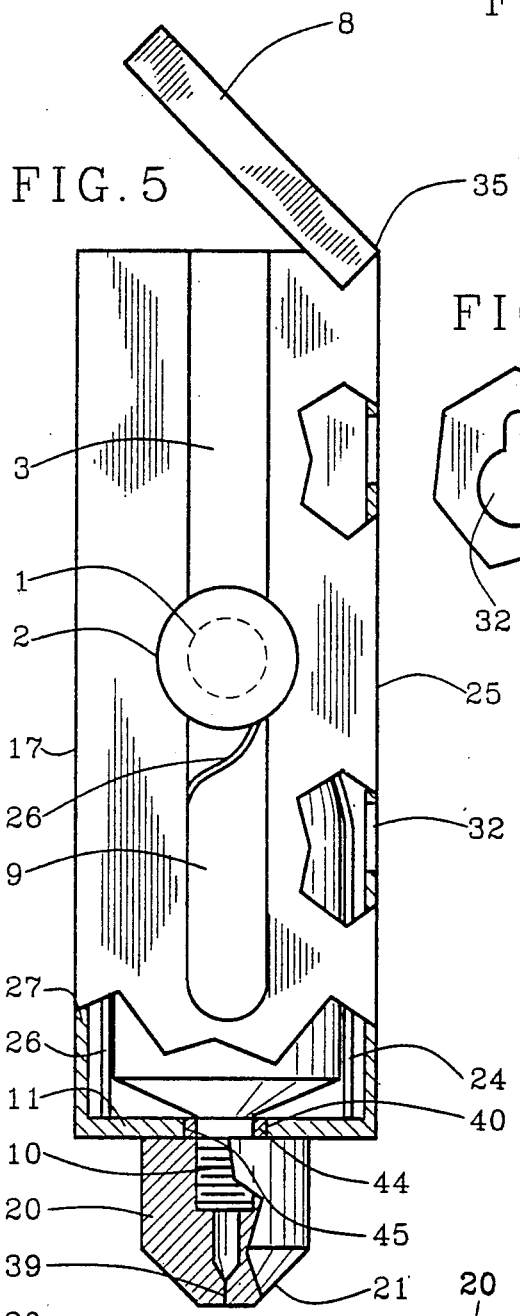
FIG. 6
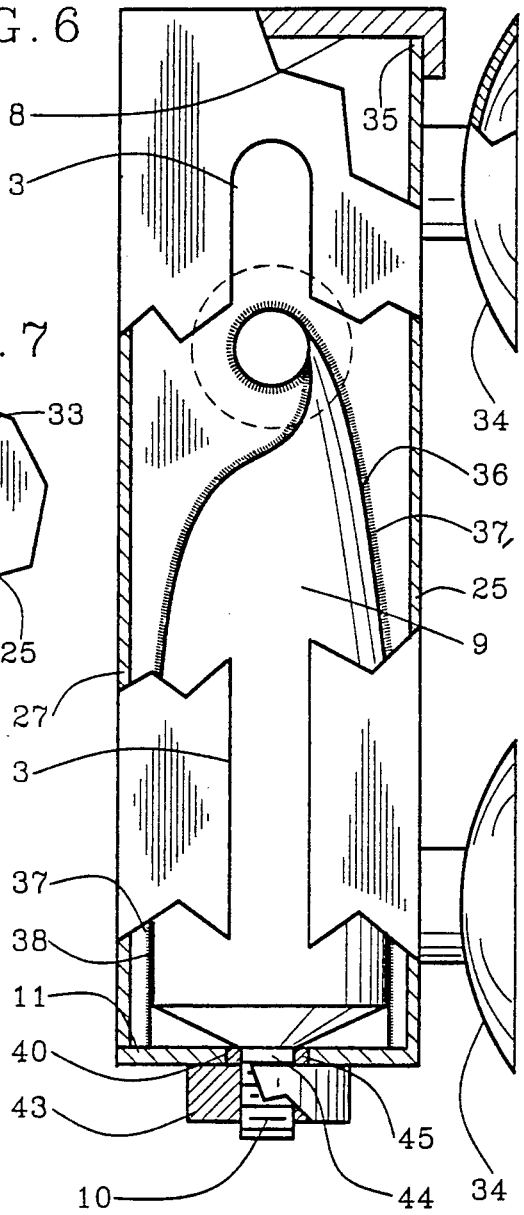
FIG. 7
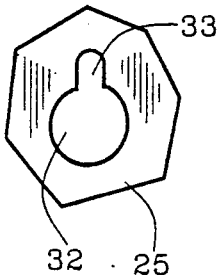
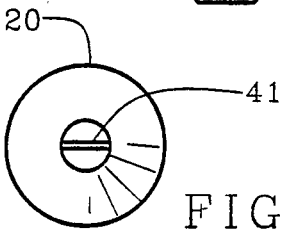
FIG. 8
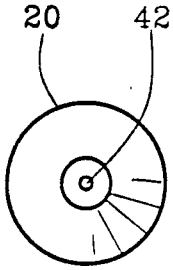
FIG. 9
FIG. 10
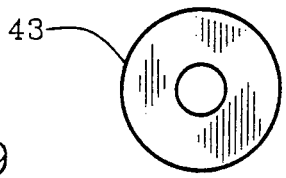

WALL MOUNTABLE TOOTHPASTE DISPENSER WITH MAGNETIC TUBE-WINDER HOLDING MEANS

BACKGROUND OF THE INVENTION

The invention relates to dispensers of products from tubular packages and more particularly to a wall-mountable dispenser or toothpaste and other products with a tube-winder rod that is rotated manually with tube-winder knobs that are positionable magnetically against sides of channels in walls of the dispenser.

Since introduction of toothpaste and other products in tubes, there have been numerous tube-holder and tube-product-dispenser devices. But none have become widely used. It is believed that the simplicity, attractiveness and convenience of this invention will change this situation.

One of the early patents in this filed was U.S. Pat. No. 1,839,542 issued to Ferguson in 1932. The Ferguson device provided for winding tubes around a shaft inside of a container and a means for opening an ejection spout with a toothbrush. But there was neither a means to assure sufficiently tight rolling of the tube on the shaft nor means to prevent unrolling of the tube. Others followed with unique methods for accomplishing substantially the same objectives but without overcoming problems with the Ferguson device. They included Ruth, U.S. Pat. No. 2,097,308, Arquelles et al., U.S. Pat. No. 2,760,681, and Locke, U.S. Pat. No. 2,605,932. Then Barton, U.S. Pat. No. 3,074,598 provided compression rollers and Freeman, U.S. Pat. No. 3,241,721 provided a single compression roller to overcome part of the problems associated previous devices. But they differ considerably from the working relationships of parts in this invention.

SUMMARY OF THE INVENTION

One object of this invention is to provide a tube-product dispenser that can be attached to a wall or a mirror for convenient dispensing of toothpaste onto a toothbrush.

A second object is to prevent a tube from unwinding after it has been wound onto a tube-winder rod.

Another object is to empty all of the contents of a toothpaste tube when it is wound onto a tube-winder rod.

Even another object to provide optionally left-handed or right-handed operation of the dispenser.

A further object is to provide attractiveness of the dispenser.

An additional object is to provide such convenient use of toothpaste and toothbrush that it will encourage regular and frequent brushing of teeth.

A tube-product dispenser is provided with a tube-winder knob at each end of a slotted tube-winder rod that is extended through channels at opposite sides of a container into which a tube is inserted. A magnetic ring with magnetic attraction to surfaces of the channels holds the knobs with sufficient rigidity to prevent unwinding of the tube after it has been wound onto the rod. Bondable strips with magnetic or other attraction to each other positioned at opposite sides of the tube are wound together in binding contact with the effect of squeezing sides of the tube together and further preventing unwinding of the tube. A spout holder is threaded onto the exit spout of the tube at the opposite side of the container bottom with a spout orifice into which the spout is positioned for use. A resilient orifice in the spout holder forms contents of the tube into ribbon shape as ejected and prevents drip from the tube when not being used. Tooth brushes and ornamentation are positionable on the outside surface of the container. The container is attachable to a wall with nail-head orifices and to a mirror or other smooth surface with suction cups.

These and other objects and advantages of this invention may become more readily apparent from a detailed description of the preferred embodiments in conjunction with drawings.

BRIEF DESCRIPTION OF THE DRAWINGS

The nature of this invention is claimed as described in relation to the following drawings wherein:

FIG. 5 is a cutaway side view of a displaceable-top embodiment;

FIG. 6 is a cutaway side view of a movable wall embodiment;

FIG. 7 is a sectional view of nail-head holder orifice;

FIG. 8 is a bottom view of a resilient ribbon-dispenser orifice;

FIG. 9 is a bottom view of a resilient round-dispenser orifice; and

FIG. 10 is a bottom view of a hand-turnable spout-holder nut.

DESCRIPTION OF PREFERRED EMBODIMENTS

Figure 1:
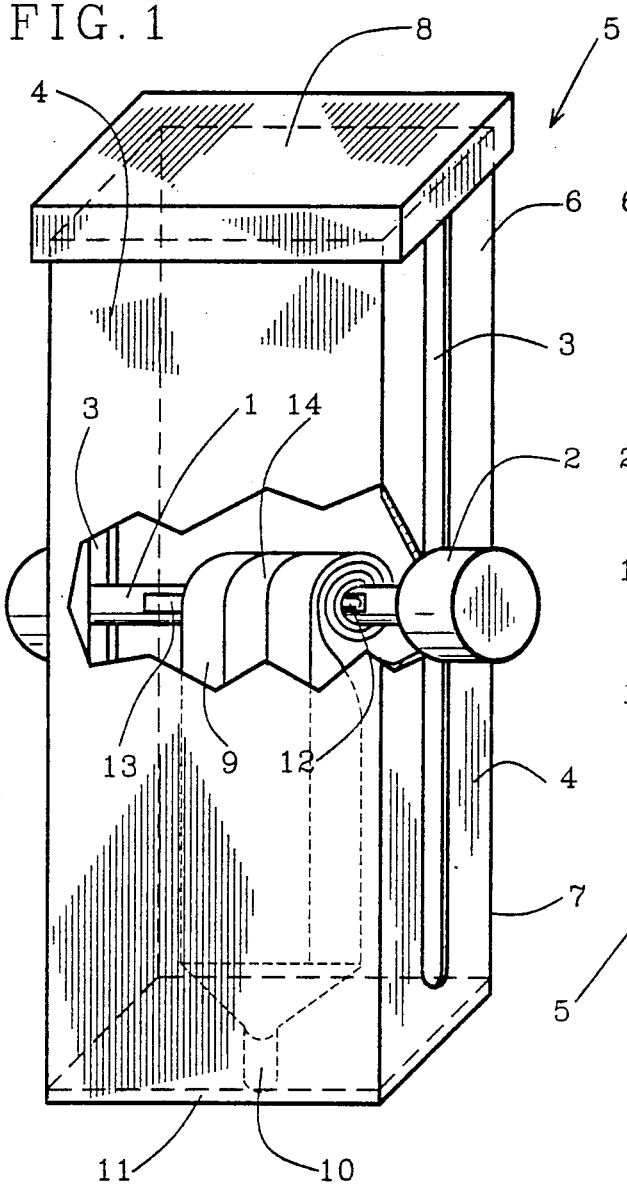
FIG. 1 is a cutaway perspective view.

Referring to FIG. 1, a tube-winder rod 1 is turnable by a tube-winder knob 2 that is attachable in quick-disconnect fashion to each end of the rod 1. Rod channels 3 in side walls 4 of container 5 are extended from a top section 6 to the vicinity of a bottom section 7 of the container 5. A container top 8 is positionable over the top section 6 of the container 5 in a manner that provides rigidity to the container 5. The top 8 can be hinged or removable. A tube 9 of toothpaste or other substance is positionable in the container 5 with a spout 10 at the container bottom 11 and a creased tube bottom 12 insertable into tube-winder orifice 13. A tube side-bonding strip 14 can be provided on each side of the tube 9 to hold sides of the tube together to prevent unwinding of the tube 9 and to cause its sides to be tightly in contact when wound in order to maximize completeness of discharge of materials from the tube 9 when it is wound onto tube-winder rod 1.

Figure 2:
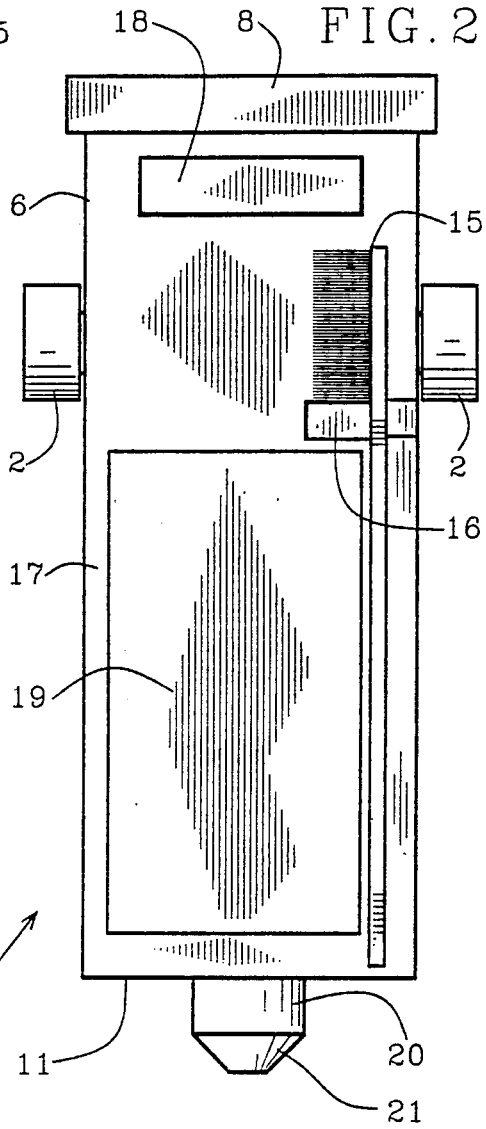
FIG. 2 is a front elevation view.

Referring to FIG. 2, a toothbrush 15 is positionable in a toothbrush holder 16 on a front surface 17 of the container 5. A nameplate 18 and an aesthetics plate 19 for pictures, rhymes and other attractiveness features can be positioned also on the container front 17 and perhaps be made removably changeable by also utilizing magnetic attraction. The tube-winder knobs 2 are illustrated in a position relatively near the container top 8. A hand-turnable flow-control nut 20 with a resilient seal 21 are provided below the container bottom 11 to hold the tube 9 and to prevent leakage when the tube 9 is not being used.

Figure 3:
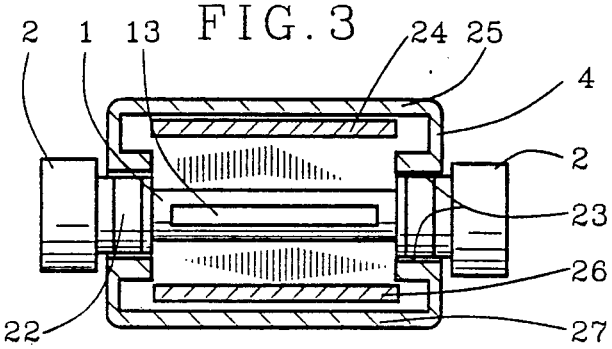
FIG. 3 is a top view with the top removed.

Referring to FIG. 3, the tube-winder knobs 2 are provided with a magnetic ring 22 having magnetic attracting to rod-channel inside surfaces 23. A rear bond strip 24 can be positioned next to the inside surface container rear wall 25 and a front bond strip 26 can be positioned next to the inside surface of container front wall 27. Such rear bond strips 24 and 26 may consist of hook and loop fastening material such as VELCRO.

Figure 4:
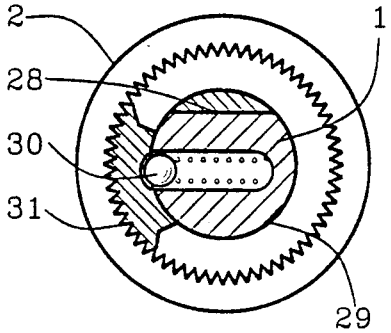
FIG. 4 is an inside end view of a tube-winder knob.

Referring to FIG. 4, the tube-winder knob 2 can be quick-disconnected from tube-winder rod 1 by internal threads in the tube-winder knob 2 and external threads on the tube-winder rod 1. However, there are other well-known quick-disconnect methods that can be used also. One is simply matching flat surfaces 28 at a juncture of inside and outside diameters 29 and employing some form of resiliency, such as a spring-loaded ball and socket 30, to hold them together. The magnetic ring 22 can be provided with optional ridges 31 for increased resistance to unwinding motion, particularly if bond strips 24 and 26 are not employed in particular embodiments of this invention.

Referring to FIGS. 5 and 7, a nail-head orifice 32 with a nail-shank bay 33 in the rear container wall 25 can be employed for hanging this invention on a wall.

Referring to FIG. 6, suction cups 34 can be positioned on the rear wall 25 of the container 5 for attachment of this invention to a mirror, to a cabinet wall or to other sufficiently flat surfaces.

FIGS. 5 and 6 illustrate different means for opening the container 5. FIG. 5 features a top 8 that fits over sides of the container 5. FIG. 6 provides another top 8 that is attached to sides of the container 5 that rest on the container bottom 11 when the top and sides of the container 8 are raised or swiveled upwards. For either type of top construction, a hinge, not shown, is optional at the top rear edge of the container 5.

Referring to FIG. 5, the rear bond strip 24 can be attachable to or positioned on the container bottom 11 near the rear wall 25 and the front bond strip 26 can be attachable to or positioned on the container bottom 11 near the front wall 27.

Referring to FIG. 6, a rear fibrous bond strip 36 can be positioned between a rear container wall 25 and a rear side of a tube 9 with a bonding surface 37 facing rearward. A front plastic or fibrous bond strip 38 can be positioned between a front container wall 27 and a front side of the tube 9 with bonding surface 37 facing forward. The bonding surface 37 can be fibrous projections, such as hook and loop fastening method, or other form of bonding means. If a non-fibrous strips 24 and 26, such as magnetic strips are employed as shown in FIG. 5 with a bonding surface at only one side, the bonding surface is at the same side of the strips as the fibrous strips shown in FIG. 6. It can be seen that the bonding surfaces are brought together when wound on tube-winder rod 1 by hand turning tube-winder rod 2, regardless of which type of bonding material is employed.

Referring to FIGS. 5, 8 and 9, the hand-turnable flow-control nut 20 with a resilient pinch orifice 39 is threadable onto the tube spout 10 after the tube spout 10 has been inserted through anchor orifices 40 in container bottom 11. The pinch orifice 39 can take various forms such as slit 41 as shown in FIG. 8 or a circle 42 as shown in FIG. 9. Referring to FIGS. 6 and 10, a hand-turnable anchor nut 43 can be threaded onto spout 10 after it is inserted through anchor orifice 40.

Again, referring to FIGS. 5 and 6, a magnetic tube spout ring 34, may be attached around the spout 10 of the tube 9 prior to its placement into the container 5. The container 5 is provided with a magnetic surface 45 around the inner circumference of the anchor orifice 40. Once the magnetic tube spout ring 34 is inserted through the anchor orifice 40, the magnetic attraction between the magnetic tube spout ring 34 and magnetic surface 45 will hold the tube 9 sufficiently rigid to further prevent wobbling when the tube is wound by turning tube winder knobs 2.

All edges, corners and portions of the device that come in contact with users or with use-conditions are rounded, beveled or otherwise constructed to be user-friendly.

Although this invention is intended primarily for toothpaste, it can be used for a wide variety of tube-dispensed substances. Glue, paste and some kitchen products are examples of additional uses within the intent of this invention.

All alterations, adaptations, applications and modifications of this invention that are foreseeable from the above description and appended claims are included in this invention.

Having thus described my invention, I claim the following:

1. A wall-mountable tube-packaged-product dispenser comprising;

a tube container with inside dimensions selectively longer than tubes to be inserted into it, selectively wider from side-to-side than tubes that are flattened within it and selectively thicker from front-to-back than diameters of tubes to be inserted into it;

a container bottom to which side walls of the container are attachable;

a tube outlet orifice in the container bottom;

a key channel extended selectively between a vicinity of a top and a vicinity of a bottom of each side of the container;

a tube-winder rod extendible through the key channels from an outside surface of the container at one side of the container to an outside surface of the opposite side of the container;

a tube-winder-rod orifice extended from side-to-side of the tube-winder rod with a size and shape to receive a bottom of a tube insertable into the container;

a tube-winder knob attachable to each end of the tube-winder rod at positions exterior to outside surfaces of the sides of the container and having a diameter selectively larger than a cross-sectional dimension of the tube-winder-rod;

a circumferential magnetic ring positioned selectively between the tube-winder knob and the tube-winder-rod orifice; and a surface of each key channel having magnetic attraction to the circumferential magnetic ring.

2. A wall-mountable tube-packaged-product dispenser according to claim 1 and further comprising;

a strip of windable bonding material positionable at front and back surfaces of the container for bonding to matching bonding material on front and back surfaces of a tube inserted the container.

3. A wall-mountable tube-packaged-product dispenser according to claim 2 and further comprising:

a container cover positionable over the top of the container and extendible on the sides of the container in a manner that aids rigidity of the container.

4. A wall-mountable tube-packaged-product dispenser according to claim 2 wherein the windable bonding material is a magnetic material.

5. A wall-mountable tube-packaged-product dispenser according to claim 2 wherein the windable bonding material is a magnetic material at opposite sides of a tube insertable into the container.

6. A wall-mountable tube-packaged-product dispenser according to claim 2 wherein the windable bondable material is fibrous.

7. A wall-mountable tube-packaged-product dispenser according to claim 2 wherein the windable bonding material is attachable to inside surfaces of the bottom of the container.

8. A wall-mountable tube-packaged-product dispenser according to claim 1 wherein the tube-winder knobs are fixedly attached to opposite ends of the tube-winder rod.

9. A wall-mountable tube-packaged-product dispenser according to claim 1 wherein at least one of the tube-winder knobs is quick-disconnect attachable to an end of the tube-winder knob.

10. A wall-mountable tube-packaged-product dispenser according to claim 1 and further comprising:

a tube-packaged-product spout attachable to the bottom of the container and having a resiliently self-sealing outlet orifice.

11. A wall-mountable tube-packaged-product dispenser according to claim 10 where in the resiliently self-sealing outlet orifice is linear, such that a tube-packaged product expelled therefrom by winding action from rotation of the tube-winder knobs is relatively flat for providing a flat layer of a tube-packaged product on a use item placed thereunder.

12. A wall-mountable tube-packaged-product dispenser according to claim 2 and further comprising:

a tube-packaged product flow controller attachable to the bottom of the container and having a resiliently self-sealing outlet orifice.

13. A wall-mountable tube-packaged-product dispenser according to claim 3 and further comprising:

a tube-packaged product flow controller attachable to the bottom of the container and having a resiliently self-sealing outlet orifice.

14. A wall-mountable tube-packaged-product dispenser according to claim 4 and further comprising:

a tube-packaged product flow controller attachable to the bottom of the container and having a resiliently self-sealing outlet orifice.

15. A wall-mountable tube-packaged-product dispenser according to claim 5 and further comprising:

a tube-packaged product flow controller attachable to the bottom of the container and having a resiliently self-sealing outlet orifice.

16. A wall-mountable tube-packaged-product dispenser according to claim 6 and further comprising:

a tube-packaged product flow controller attachable to the bottom of the container having a resiliently self-sealing outlet orifice.

17. A wall-mountable tube-packaged-product dispenser according to claim 7 and further comprising:

a tube-packaged product flow controller attachable to the bottom of the container and having a resiliently self-sealing outlet orifice.

18. A wall-mountable tube-packaged-product dispenser according to claim 1 and further comprising:

a toothbrush holder at an outside surface of the container.

19. A wall-mountable tube-packaged-product dispenser according to claim 1 and further comprising:

a nameplate section on an outside surface of the container.

20. A wall-mountable tube-packaged-product dispenser according to claim 1 and further comprising:

an aesthetics plate on the outside surface of the container.

21. A wall-mountable tube-packaged-product dispenser according to claim 1 and further comprising:

a vertical-wall attachment means at the back surface of the container.

22. A wall-mountable tube-packaged-product dispenser according to claim 21 wherein the vertical-wall attachment means is a suction cup facing in the opposite direction of the container and attached rigidly in the vicinity of both the top and bottom of the container.

23. A wall-mountable tube-packaged-product dispenser according to claim 21 wherein the vertical-wall attachment means is a suction cup in the vicinity of the top of the container and a separate suction cup in the vicinity of the bottom of the container, both facing in the opposite direction of the container and both attachable rigidly to the container.

24. A wall-mountable tube-packaged-product dispenser according to claim 21 wherein the vertical-wall attachment means is an orifice in a plate at the back of the container for a hang-nail head and a nail-shank channel extended from the orifice for the hang-nail head to a position selectively above such orifice in the vicinity of both the top and the bottom of the back surface of the container.

25. A wall-mountable tube-packaged-product dispenser according to claim 10 wherein the resiliently self-sealing outlet orifice is a hand-turnable flow-control nut with inside-diameter threads threadable onto a tube-outlet spout at one side and having a flexible spout at the opposite side and further comprising:

a container bottom having a tube-spout orifice and being sufficiently thin to allow threading of the hand-turnable nut onto the spout at the opposite side of the container bottom from the tube to hold the tube firmly to the container bottom in addition to providing resiliently self-sealing discharge from the tube.

26. A wall-mountable tube-packaged-product dispenser according to claim 11 wherein the resiliently self-sealing outlet orifice is a hand-turnable flow-control nut with inside-diameter threads threadable onto a tube-outlet spout at one side and having a flexible spout at the opposite side and further comprising:

a container bottom having a tube-spout orifice and being sufficiently thin to allow threading of the hand-turnable nut onto the spout at the opposite side of the container bottom from the tube to hold the tube firmly to the container bottom in addition to providing resiliently self-sealing discharge from the tube.

27. A wall-mountable tube-packaged-product dispenser according to claim 12 wherein the resiliently self-sealing outlet orifice is a hand-turnable flow-control nut with inside-diameter threads threadable onto a tube-outlet spout at one side and having a flexible spout at the opposite side and further comprising:

a container bottom having a tube-spout orifice and being sufficiently thin to allow threading of the hand-turnable nut onto the spout at the opposite side of the container bottom from the tube to hold the tube firmly to the container bottom in addition to providing resiliently self-sealing discharge from the tube.

28. A wall-mountable tube-packaged-product dispenser according to claim 13 wherein the resiliently self-sealing outlet orifice is a hand-turnable flow-control nut with inside-diameter threads threadable onto a tube-outlet spout at one side and having a flexible spout at the opposite side and further comprising:

a container bottom having a tube-spout orifice and being sufficiently thin to allow threading of the hand-turnable nut onto the spout at the opposite side of the container bottom from the tube to hold the tube firmly to the container bottom in addition to providing resiliently self-sealing discharge from the tube.

29. A wall-mountable tube-packaged-product dispenser according to claim 14 wherein the resiliently self-sealing outlet orifice is a hand-turnable flow-control nut with inside-diameter threads threadable onto a tube-outlet spout at one side and having a flexible spout at the opposite side and further comprising:

a container bottom having a tube-spout orifice and being sufficiently thin to allow threading of the hand-turnable nut onto the spout at the opposite side of the container bottom from the tube to hold the tube firmly to the container bottom in addition to providing resiliently self-sealing discharge from the tube.

30. A wall-mountable tube-packaged-product dispenser according to claim 15 wherein the resiliently self-sealing outlet orifice is a hand-turnable flow-control nut with inside-diameter threads threadable onto a tube-outlet spout at one side and having a flexible spout at the opposite side and further comprising:

a container bottom having a tube-spout orifice and being sufficiently thin to allow threading of the hand-turnable nut onto the spout at the opposite side of the container bottom from the tube to hold the tube firmly to the container bottom in addition to providing resiliently self-sealing discharge from the tube.

31. A wall-mountable tube-packaged-product dispenser according to claim 16 wherein the resiliently self-sealing outlet orifice is a hand-turnable flow-control nut with inside-diameter threads threadable onto a tube-outlet spout at one side and having a flexible spout at the opposite side and further comprising:

a container bottom having a tube-spout orifice and being sufficiently thin to allow threading of the hand-turnable nut onto the spout at the opposite side of the container bottom from the tube to hold the tube firmly to the container bottom in addition to providing resiliently self-sealing discharge from the tube.

32. A wall-mountable tube-packaged-product dispenser according to claim 17 wherein the resiliently self-sealing outlet orifice is a hand-turnable flow-control nut with inside-diameter threads threadable onto a tube-outlet spout at one side and having a flexible spout at the opposite side and further comprising:

a container bottom having a tube-spout orifice and being sufficiently thin to allow threading of the hand-turnable nut onto the spout at the opposite side of the container bottom from the tube to hold the tube firmly to the container bottom in addition to providing resiliently self-sealing discharge from the tube.

33. A wall-mountable tube-packaged-product dispenser according to claim 1 and further comprising:

a spout having a spout orifice;

a thin container bottom; and a hand-turnable nut threadable onto outside-diameter threads of the tube spout inserted through the spout orifice in the sufficiently thin container bottom to allow the hand-turnable nut to be threaded onto the spout to hold the tube firmly against the container bottom while the tube-packaged product is being expelled by rotational action of the tube-winder knobs and tube-winder rod.

34. A wall-mountable tube-packaged-product dispenser according to claim 1 and further comprising:

ridges on the magnetic ring that are linear to the axis of the tube-winder knob.

35. A wall-mountable tube-packaged-product dispenser according to claim 1 and further comprising:

a spout on the tube container magnetically attracted to a magnetic surface of the tubes outlet orifice on the container bottom.

* * * * *

UNITED STATES PATENT AND TRADEMARK OFFICE

CERTIFICATE OF CORRECTION

PATENT NO. : 5,048,725

DATED : September 17, 1991

INVENTOR(S) : Mildred I. Peterson

It is certified that error appears in the above-identified patent and that said Letters Patent is hereby corrected as shown below:

In column 3, line 65, "34" should read --44--.

In column 4, lines 1 and 3, "34" should read --44--.

Signed and Sealed this

Fourth Day of May, 1993

*Attest:*

Michael K. Kirk

MICHAEL K. KIRK

*Attesting Officer*

*Acting Commissioner of Patents and Trademarks*